United States Patent [19]

Henry

[11] 4,380,144

[45] Apr. 19, 1983

[54] BELT FALSE TWISTING SYSTEM

[75] Inventor: William J. Henry, Spartanburg, S.C.

[73] Assignee: Milliken Research Corporation, Spartanburg, S.C.

[21] Appl. No.: 289,165

[22] Filed: Aug. 3, 1981

[51] Int. Cl.[3] ..... D02G 1/02; D01H 13/30

[52] U.S. Cl. ..... 57/286; 57/292; 57/295

[58] Field of Search ..... 57/286, 292, 295

[56] References Cited

U.S. PATENT DOCUMENTS 2,080,193 5/1937 Bakker ..... 57/295

3,058,291 10/1962 Heberlein et al. ..... 57/286 X 3,434,277 3/1969 Maeda et al. ..... 57/286

4,316,358 2/1982 Takai ..... 57/286

*Primary Examiner*—Donald Watkins

*Attorney, Agent, or Firm*—Earle R. Marden; H. William Petry

[57] ABSTRACT

A yarn system for continuous, synthetic yarn in which is imparted a false twist by the use of a cooperating belt system. In the use of the belt system, a cooling water recirculation system is employed to purify the recirculated water so that economy of operation can be achieved.

2 Claims, 5 Drawing Figures

BELT FALSE TWISTING SYSTEM

This is directed to a false twist crimping machine which employs a pair of endless belts to false twist the yarn thereon. The machine employs a liquid bath after the primary heaters and prior to the introduction of the yarn to the endless belt false twister. The liquid bath uses a considerable amount of water or cooling liquid in operation resulting in increased operating costs. Also, the contaminated water, after cooling of the yarn, if dumped rather than recirculated, would resume the use of considerable water treatment equipment and chemicals to reduce the contaminants therein to a condition wherein the used could be safely drained into the available water supply.

Therefore, it is an object of the invention to provide a method and apparatus to false twist filament yarn in a machine that employs a liquid cooling bath from which the liquid employed is purified and recirculated for reuse in the cooling bath.

Other objects and advantages of the invention will become clearly apparent as the specification proceeds to describe the invention, with reference to the accompanying drawings, in which.

Figure 1:
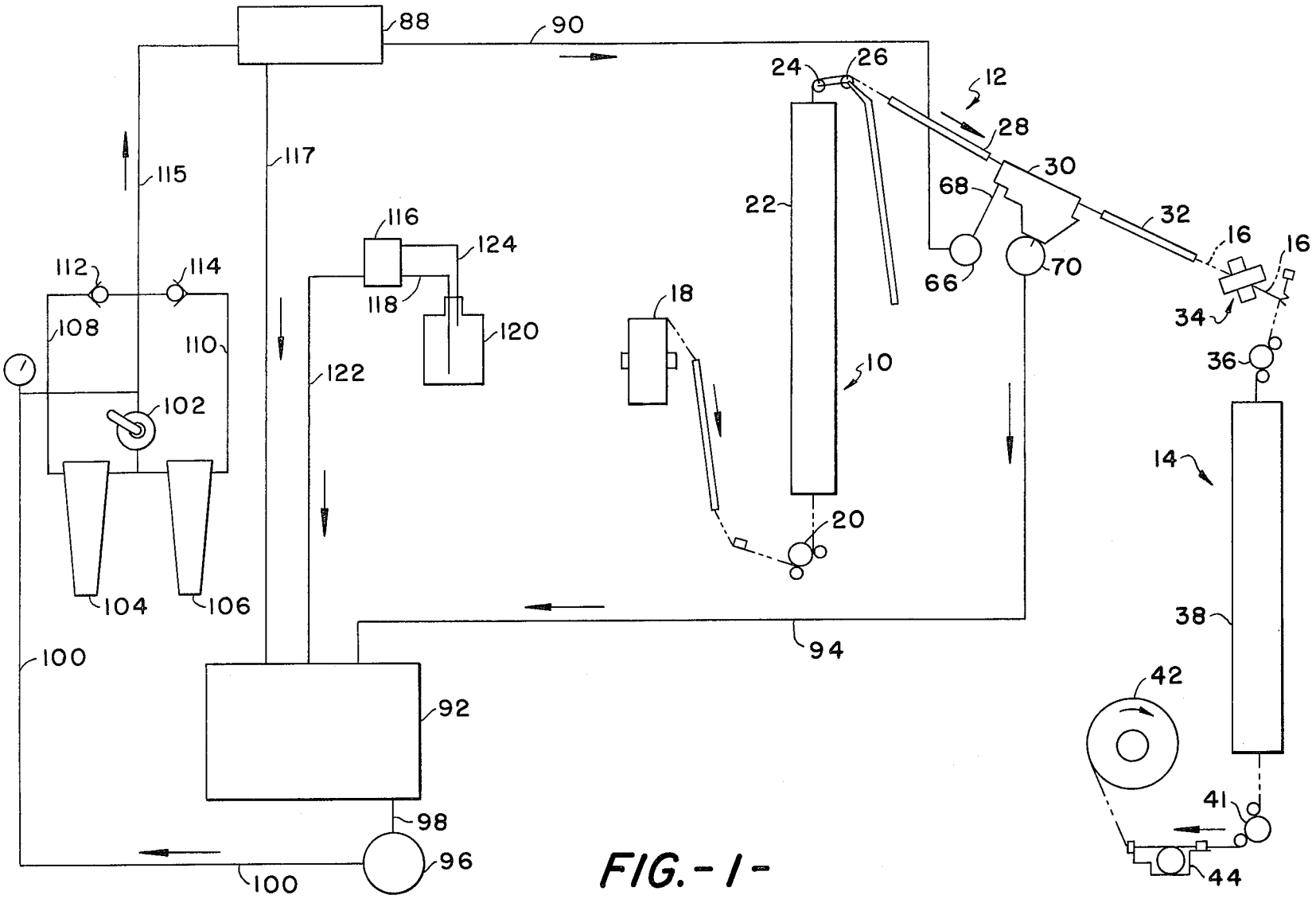
FIG. 1 is a schematic representation of a single position of a multiple position belt false twisting machine.

Looking now to the drawings, FIG. 1 is a schematic representation of one position of a multiple position false twist crimping machine which processes continuous filament, synthetic yarn such as nylon, polyester, etc. The apparatus consists basically of three zones comprising the yarn supply and primary heating zone 10, a cooling and balloon control zone 12 and a false twist and take up zone 14.

The yarn 16 to be processed is wound on a package 18 and mounted on a creel (not shown) in the zone 10. From the creel the yarn 16 from the packages 18 is drawn by the feed roll 20 and delivered upwardly through the tubes of the primary heater 22 to the guide rolls 24 and 26. From the guide rolls 24 and 26, the yarn enters zone 12 and is cooled and guided therethrough by the balloon control plate 28 to the cooling bath 30 in zone 14. From the bath 30, the yarn 16 is delivered over the secondary short balloon control plate 32 to the belt false twisting member 34 by the feed roll 36. From the feed roll 36, the false twisted yarn 16 is guided downwardly through the tubes of the secondary heater 38 by the feed guide roll 41 and delivered to the take-up package 42 through the yarn feeler and oiler 44.

Figure 2:
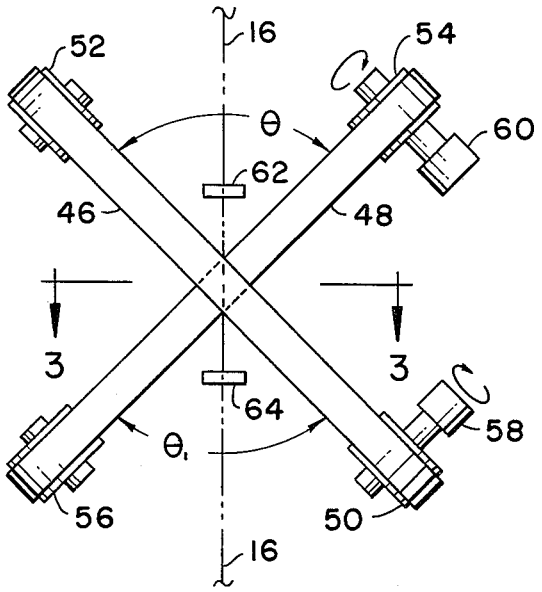
FIG. 2 is a schematic representation of the belt false twisting mechanism.
Figure 3:
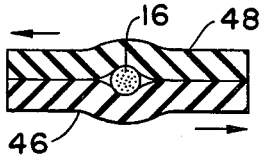
FIG. 3 is a cross-section view taken on line 3—3 of FIG. 2.

FIGS. 2 and 3 show the basic action of the belt false twist mechanism and will be explained in further detail. The false twist apparatus generally indicated as 34 comprises two endless flat surfaced belts 46 and 48, forming a pair, which are made of, for example, a synthetic rubber to have work surfaces, respectively, of a small friction coefficient therebetween. These endless belts 46 and 48 are supported on pulley 50, 52 and 54, 56, respectively, so as to provide straightly extending regions between their respective associated pulleys. These belts

46 and 48 are driven in different directions indicated by the arrows shown, by means of drive pulleys, 58 and 60, respectively. These drive pulleys are driven synchronously through, for example, synchronous motors so shown, to insure that the belts 46 and 48 are caused to run in their own direction at the same surface velocity. As shown in FIG. 2, these two endless belts 46 and 48 thus travel in different directions at a predetermined angle at the same speed while their surface comes into contact with each other successively at the site of their crossing.

The filament yarn 16 which is subjected to heating, upstream of the false twisting apparatus 38, by the heating unit 22, and via an inlet guide 62, the filament yarn 16 is passed progressively through the region of an angle which is defined between the straightly extending regions of the two endless belts 46 and 48 which travel in different directions. Therefrom, the filament yarn 16 enters progressively into the twisting zone, i.e., between the contacting surfaces of the crossing straightly extending regions of the two running belts 46 and 48, where the filament yarn 16 is twisted while being nipped successively along its length between these contacting surfaces of the running belts 46 and 48, while being urged, at the same time, to be discharged successively from the nipping zone. Therefrom, the filament yarns which is now set free to be untwisted loose is taken onto the take-up device via an outlet guide 64.

Figure 4:
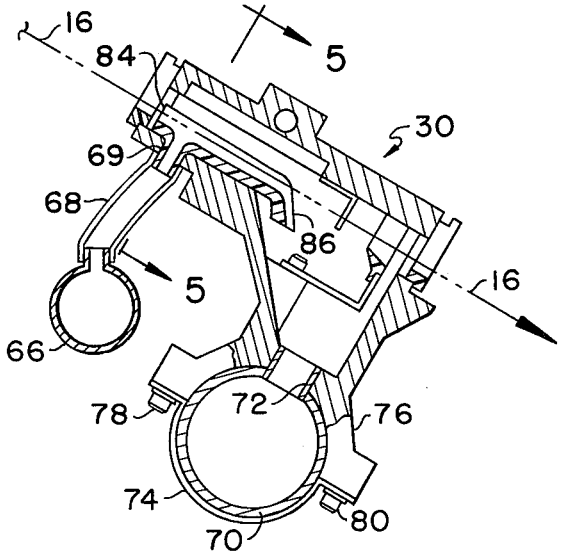
FIG. 4 is a partial section view taken through the cooling bath shown in FIG. 1; and, FIG. 5 is a cross-sectional view taken on line 5—5 of FIG. 4.
Figure 5:
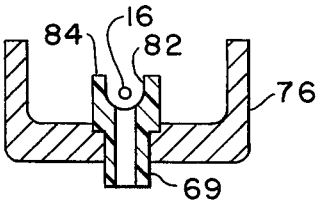

FIGS. 1, 4 and 5 show the cooling liquid bath 30 and the recirculation system in detail. The bath 30, per se, shown in FIGS. 4 and 5, is connected to the liquid supply line 66 by a conduit 68 and nipple 69 at one end and connected to the return conduit 70 by a nipple 72 at the other end. The bath 30 is secured in position by a U-shaped clamp 74 which telescopes the conduit 70 and secured to the body 76 of the bath 30 by suitable screws 78 and 80. As the yarn 16 passes through the channel 82 in the member 84 in the bath 30, water or other suitable liquid is introduced into the channel 82 via the conduit 68 and flows down the channel 82 as it cools the yarn 16, removes finish thereon and provides lubrication for the belts 46 and 48. When the cooling liquid reaches the end of the channel 82 it is guided by downwardly directed lip 86 into the return conduit 70 through the nipple 72.

Looking now to FIG. 1 the cooling liquid or water recirculation system is shown in detail. As mentioned briefly before a fairly large amount of water is used to cool the yarn in a multiple position machine and therefore, to decrease operating expense of the apparatus, a water purification and recirculation system is employed. It is necessary to chlorinate and filter the recirculated water to lessen the tendency of the bacteria to act on the yarn finish and polymer particles in the water to prevent the conduits of the system from plugging up and reducing the flow of cooling water in the system.

As shown in FIG. 1, the cooling liquid from the reservoir 88 is fed by gravity down to conduit 66 by conduit 90. From the return conduit 70, the used cooling liquid is fed by gravity to the sump tank 92 through conduit 94. To kill the bacteria in the water in the sump tank, periodically metering pump 116 will be activated to supply chlorinated water from the container 120 through the conduit 118 to the sump and then through conduit 122 into the sump tank 92. The pump 116 also returns excess chlorinated water pumped, back to the container 120 through conduit 124.

The treated water from the sump 92 is sucked therefrom through conduit 98 by pump 96 and pumped to the valve 102 through conduit 100. The flow of treated water is directed to either filter 104 or 106 by valve 102 to remove particles of material therein and is delivered to the reservoir 88 via either check valve 112 or 114 and conduit 115. The check valves 112 and 114 cooperate with valve 102 to prevent cross-flow of treated water from one filter to the other through either conduit 108 or 110. An overflow conduit 117 is employed to direct overflow coolant liquid from the reservoir 88 to the sump 92.

It is obvious that a false twist crimping machine has been described which efficiently utilizes cooling liquid that can be and has been recirculated and purified to provide reduction in operating expenses for such a system.

Although the preferred embodiment of the invention has been described, it is contemplated that many changes may be made within the scope of the invention and I desire to be limited only by the scope of the claims.

I claim:

1. A false twist crimping machine comprising: a primary heater, means to supply a yarn to said primary heater, a cooling bath, means to guide the yarn from said primary heater to said cooling bath, a belt false twisting mechanism, means to supply the yarn to said false twisting mechanism, means to take-up the yarn false twisted from said mechanism, means to supply a cooling liquid to said cooling bath and means operably associated with said cooling bath to purify and recirculate cooling water from said cooling bath to said means to supply a cooling liquid.

2. The method of false twist crimping a continuous multifilament, synthetic yarn in a machine employing a belt type false twist mechanism comprising the steps of: supplying a continuous, multifilament synthetic yarn, heating the supplied yarn, providing a cooling bath, supplying a cooling liquid to the cooling bath, directing the heated yarn through the cooling bath, extracting the cooling liquid from the cooling bath and purifying same, recirculating the purified cooling liquid to the cooling bath, supplying the cooled yarn to the belt type false twist mechanism, false twisting the yarn in the mechanism and taking up the false twisted yarn.

* * * * *